United States Patent [19]

Wilkins et al.

[11] 4,447,986

[45] May 15, 1984

[54] ADJUSTABLE BOXCAR DOOR WITH DOUBLE ROLLER BOGEY TRAVERSE MECHANISM AND METHODS FOR FABRICATING AND INSTALLING SAME

[75] Inventors: James H. Wilkins, DeSoto, Mo.; Mark Payne, North Little Rock, Ark.

[73] Assignee: Missouri Pacific Railroad Company, St. Louis, Mo.

[21] Appl. No.: 379,483

[22] Filed: May 18, 1982

Related U.S. Application Data

[63] Continuation of Ser. No. 117,285, Jan. 31, 1980.

[51] Int. Cl.[3] ..... E05D 13/02

[52] U.S. Cl. ..... 49/426; 49/472

[58] Field of Search ..... 49/425, 426, 472, 55; 16/100, 103, 104

[56] References Cited

U.S. PATENT DOCUMENTS

| | | | |
|---|---|---|---|
| 1,925,655 | 9/1933 | Ditchfield | 49/426 |
| 2,047,855 | 7/1936 | Cornish | 16/104 |
| 2,114,756 | 4/1938 | Wasberg | 49/472 X |
| 2,310,539 | 2/1943 | Nelson et al. | 49/55 X |
| 2,902,122 | 9/1959 | Beauchamp | 49/426 |
| 3,996,643 | 12/1976 | Steigerwald | 49/425 X |

*Primary Examiner*—Kenneth Downey

*Attorney, Agent, or Firm*—Rogers, Eilers & Howell

[57] ABSTRACT

An adjustable rolling type boxcar door has a main panel and a telescoping adjustable panel at its bottom for adjusting the overall height of the door to fit a variety of door openings. The adjustable panel is slidably retained between side frames in the main panel by stop blocks mounted along the inside edges of the side frames. The width of the door may be also adjusted by positioning a spark strip either closer or further away from the inside edge of the door opposite the closure mechanism. A pair of double roller, pivotally mounted bogeys are mounted in the adjustable panel and support the door from a door track mounted to the side of a boxcar. The double roller bogeys provide an improved traverse mechanism for supporting the considerable weight of a boxcar door and carrying it across what may be an uneven and rough track. There is also disclosed a method for adjusting the height of the door and installing it to a boxcar including the steps of measuring the height of the door opening, adjusting the height of the door by fixing the position of the adjustable panel, lifting the door, inserting the top of the door into the top door retainer, and positioning the lower end of the door on the door track and securing it into place by welding J-straps to the lower end of the door.

12 Claims, 8 Drawing Figures

ADJUSTABLE BOXCAR DOOR WITH DOUBLE ROLLER BOGEY TRAVERSE MECHANISM AND METHODS FOR FABRICATING AND INSTALLING SAME

This is a continuation of Ser. No. 117,285, filed 1/31/80.

BACKGROUND AND SUMMARY OF THE INVENTION

Because of the extensive use and statistical certainty of damage through accident, abuse or the like, a railroad or any other company that owns and operates boxcars must contend with the problem of repairing and replacing rolling type boxcar doors. As the boxcars become disabled, it is very important to be able to repair or replace the door promptly so that boxcars do not remain idle any more than necessary. A boxcar represents a substantial capital investment which is not producing income if it is "off line" awaiting repairs or the availability of a replacement door. All companies strive to make maximum use of their capital investment and it makes no economic sense for a boxcar to be idle for lack of a part representing only a fraction of the total investment.

Unfortunately, the boxcar door industry has developed over the years with the various manufacturers supplying different sizes of rolling type boxcar doors so that no industry standard for size has been set. Also, because boxcar manufacturers generally supply boxcars according to their own standard specifications, specifications for door openings have continually changed over the years, so that users of railroad boxcars have accumulated an inventory of boxcars having door openings and doors with widely varying dimensions. For example, one railroad has an inventory of approximately 14,000 boxcars with 37 different sizes of door openings and doors. As is apparent, this failure to set industry standards and lack of coordination and continuity between the boxcar and door manufacturers has created a maintenance nightmare for boxcar users. Because of the variety of door sizes, a substantial capital investment is required to carry an inventory sufficiently varied to ensure that the right size doors are available. This greatly increases the amount of inventory investment required for replacement doors and also increases the possibility that the right size boxcar door is not available to make a needed repair or replacement.

The type of car which is involved in an accident or deteriorates sufficiently to require repair can only be statistically predicted and a door inventory must be selected and maintained from this prediction. However, a shortage of doors often develops because of the widely varying dimensions of the doors, the relatively few number of door manufacturers, and the long delivery times. It must be remembered that boxcar doors are quite large and heavy, being constructed of steel castings and plating which generally take a significant amount of manufacturing and assembly time. Thus, door manufacturers generally quote extended delivery times of 6 months or more. An inventory "prediction" must therefore account for 6 months of accidents, which is virtually impossible. As a result, extensive repairs are made to doors that would otherwise be considered scrap, and other boxcars must be held out of service until the specific door required can be ordered and received, all at great expense and waste of capital investment.

Another maintenance problem which exacerbates those mentioned above concerns the roller mechanism for the roller type door. Generally, in the prior art, a single roller with a fixed axle is provided at each end of the door. A rail is secured to the side of the car door and the door rolls along the rail to move between its open and closed positions. Thus, the full weight of the door must be supported from these two rollers having fixed axles although the weight of the doors may be quite substantial, approaching 1000 pounds. Because of the abuse and damage received during usage, it becomes very likely for either the door track to develop kinks or the rollers to become jammed or otherwise damaged such that the door becomes inoperable or only operable with great difficulty. To maintain a car in service, a badly operated door may be ignored which presents a safety hazard to the men opening and closing these doors. This also reduces the effectiveness of the boxcar as power equipment may be required to operate these doors. Thus, the failure of the roller mechanism and the door track contributes to the failure rate of boxcar doors and increases the maintenance problems associated therewith.

To solve these problems applicants have designed and built a rolling type boxcar door which provides an adjustable height and width as well as an improved traverse mechanism utilizing a pair of pivotally mounted, double-wheeled bogeys. Special attention has been given to developing a universal door having an improved and easily replaceable traverse mechanism by providing an adjustable panel at the lower end of the door which also serves as the mounting position for the double roller bogeys. The adjustable lower panel is slidably retained at the lower edge of the door between a pair of side frames, one mounted to each side of the main door panel. A stop block mounted to the inside of each side frame slidably captures the adjustable panel and allows it to be telescoped with the main door panel to adjust the overall door height. The adjustable panel is welded in place at the proper height, but can be cut free later, as desired. Thus, the entire traverse mechanism can be replaced by replacing the adjustable panel.

The width of the door may be also adjusted by changing the mounting position of a vertically mounted spark strip. As is known in the art, the spark strip on the car door interlocks with a spark strip on the side of the boxcar to achieve a seal at the door edge. Of course, a seal at the other edge of the door is provided by the edge of the door engaging the frame or another car door.

A significant advantage of applicant' new door design is that it drastically reduces the amount of inventory of doors which must be maintained to service a large number of boxcars. For example, applicants have found that eight basic door sizes having the adjustable panel feature can replace thirty-seven different doors from various manufacturers. Thus, an inventory of less than one-fifth (1/5) the number of doors previously required can be carried to support the same number of boxcars. The versatility of applicant' door also reduces the possibility of an out-of-stock condition on any one size as a greater number of each kind of door may be carried in stock for the same investment. It is further anticipated that the cost of the doors may be significantly reduced as applicants' adjustable door requires no castings and may be manufactured on a production line basis whereas custom built doors as in the prior art utilize castings and must be produced on an order by order basis.

Applicants' improved traverse mechanism has special advantages over the prior art which helps to minimize the door maintenance problem. With the prior art designs, proper door operation depended on a straight and level track and the smooth rolling of a pair of fixed axle traverse wheels. Any damage or failure of either the track or a traverse wheel greatly increased the force required to operate the door. Furthermore, even when newly installed, the fixed axle traverse wheels require a significant force to be operated merely because of the manufacturing tolerances in both the door and the track. However, applicants' double roller bogeys significantly reduce the amount of force required so that a man may move what may be a 1,000 pound door with the force of his arm only. This is achieved by a pair of pivotally mounted double roller bogeys which "step" up and over any kinks or obstructions in the door track. Thus, it is no longer necessary for the door track to remain absolutely straight and level to ensure easy opening and closing of the door. Furthermore, by mounting the bogeys in the adjustable panel, should the traverse mechanism fail or be damaged, it may be easily replaced along with the adjustable panel. This greatly reduces the time required to repair a door, and also saves the replacement of the entire door as prior art doors are often scrapped for failure of the traverse mechanism.

Thus, applicants' have succeeded in inventing an adjustable door which solves industry wide problems experienced by every user of boxcars having rolling type doors. Problems with the traverse mechanism inventory investment, replacement door availability, idle capital investment represented by off the line boxcars awaiting doors, and maintenance problems associated with the tendency of doors and door tracks to become damaged are greatly reduced. These and other advantages are further explained in the drawings and description of the preferred embodiment.

DETAILED DESCRIPTION OF THE PREFERRED EMBODIMENT

Figure 1:
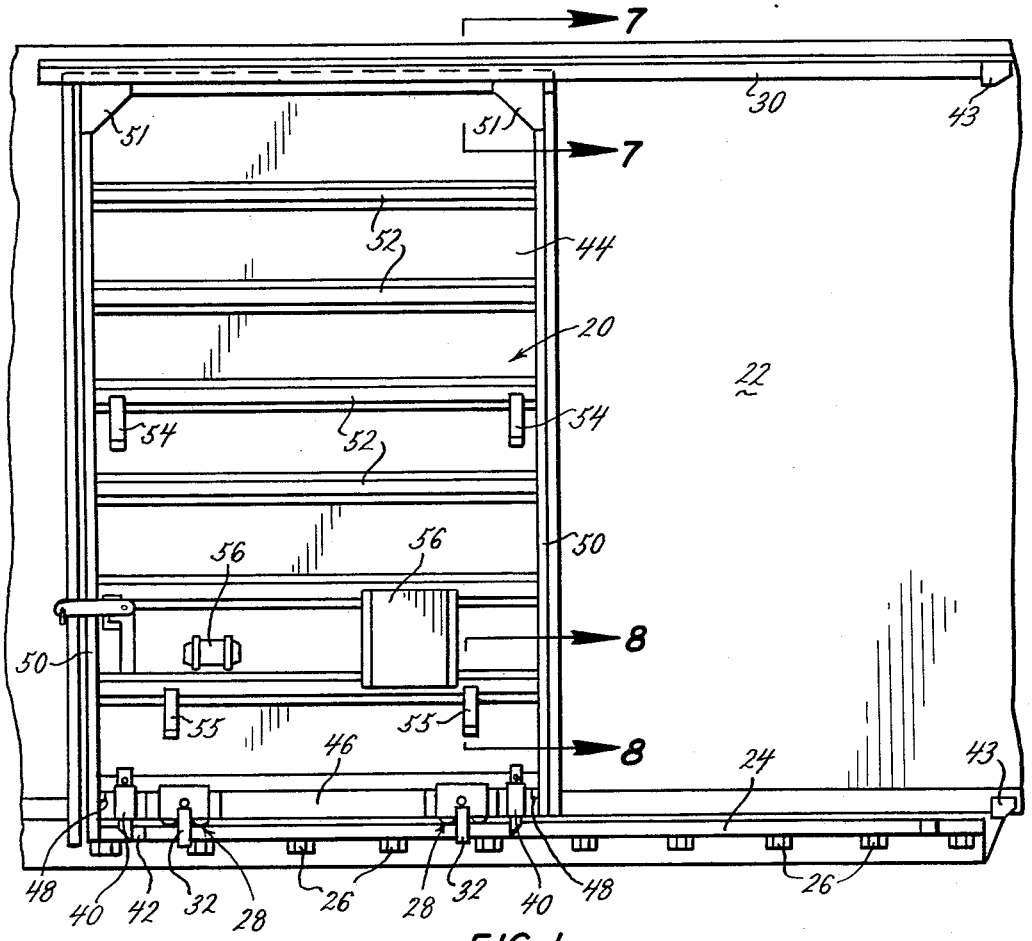
FIG. 1 is a partial view of a boxcar with applicants' adjustable door mounted thereon.
Figure 7:
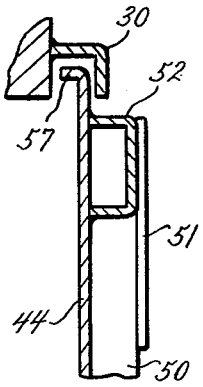
FIG. 7 is a cross-sectional view taken along the plane of line 7—7 in FIG. 1 and detailing the top door retainer.
Figure 8:
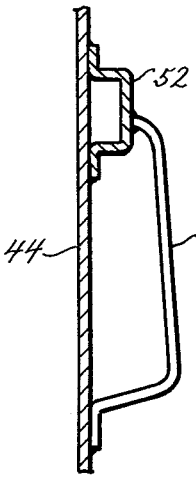
FIG. 8 is a cross-sectional view taken along the plane of line 8—8 in FIG. 1 depicting an operating handle.
Figure 2:
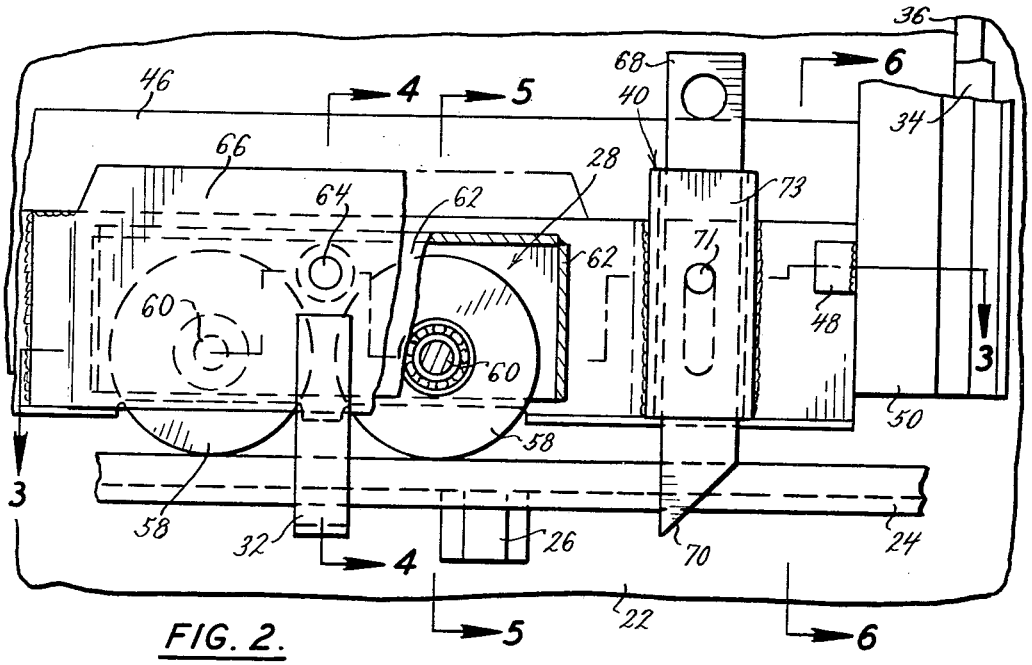
FIG. 2 is an enlarged partial view of the lower right hand corner of applicants' adjustable door detailing the double roller bogey.
Figure 4:
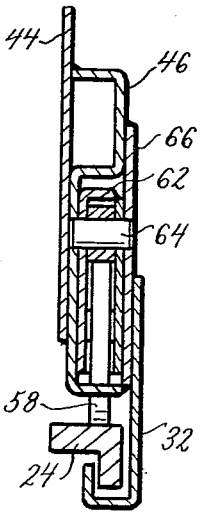
FIG. 4 is a cross-sectional view taken along the plane of line 4—4 in FIG. 2 detailing the pivot pin for the double roller bogey.
Figure 5:
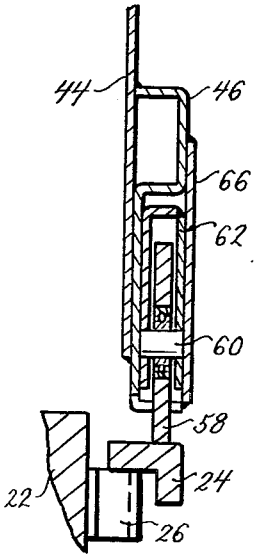
FIG. 5 is a cross-sectional view taken along the plane of line 5—5 in FIG. 2 and detailing the positioning of a (traverse) wheel within the bogey.

Applicants' adjustable door 20 is shown in FIG. 1 mounted to the side of a boxcar 22 and supported therefrom by a door track 24. The door track 24 is secured to the side of the boxcar by a plurality of braces 26. A pair of double roller bogeys 28 support the door from the door track 24 and roll along the track as the door moves between the open and closed positions. A door top retainer 30 is mounted along the sidewall of the boxcar 22 and the adjustable door 20 fits up underneath the door retainer 30 to maintain the top of the door 20 adjacent the boxcar 22 during use. A pair of J-straps 32, best shown in FIGS. 2 and 4, are welded to the adjustable door 20 and extend down around the door track 24 to prevent the bottom of the adjustable door 20 from leaving the side of the door track 24.

Figure 3:
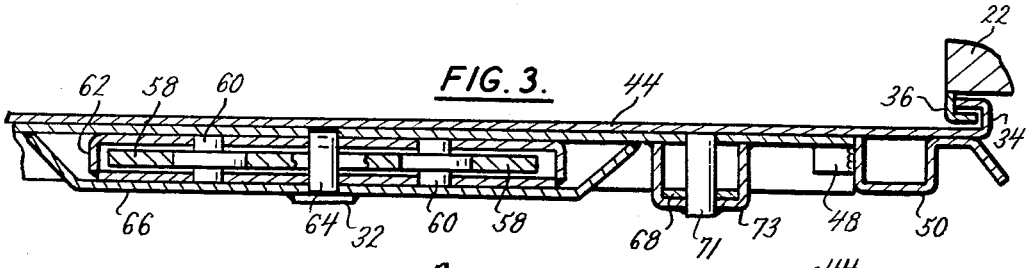
FIG. 3 is a partial cross-sectional view taken along the plane of line 3—3 in FIG. 2 and detailing the various pivot pins and stop block.

A spark strip 34 is welded to the back of the door 20 and is positioned to engage a mating spark strip 36 vertically mounted to the boxcar 22 along the right hand side of the door opening. This is best shown in FIG. 3. The spark strips 34, 36 provide a seal between the adjustable door 20 and boxcar 22 along the right-hand side of the door opening. A pair of safety stops 40 are mounted to the adjustable door 20, one at either end, and serve to lock the door in either the fully opened or fully closed position by engaging lock operators 42 mounted along the door track 26. Safety stops 40 prevent an unlatched door from rolling freely between the open and closed positions as the boxcar is moved. Similarly, door stops 43 are mounted at the fully open end of the door track 24 and door top retainer 30 to prevent the door 20 from leaving the track 24. Thus, applicants' adjustable door 20 may be moved along the door track 24 between its fully open and fully closed positions supported by double roller bogeys 28 with the door 20 being guided and retained in place, as described. Applicants will now describe and explain in more detail the various individual elements of the adjustable door 20 as is shown in the drawings.

Figure 6:
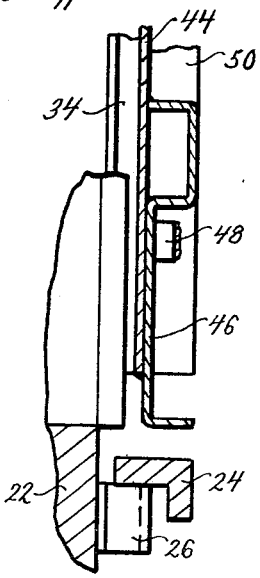
FIG. 6 is a cross-sectional view taken along the plane of line 6—6 in FIG. 2 and detailing the stop block and J-strap mounting.

Applicants' adjustable door 20 includes a main panel 44 and an adjustable panel 46 which is slidably retained in the bottom of the main panel 44 by stop blocks 48 and are welded to side rails 50 a distance from the panel 44 slightly greater than the thickness of the panel 46. A pair of side rails 50 extend vertically along the sides of main panel 44 and guide the movement of adjustable panel 46. As is best shown in FIGS. 2 and 6, the adjustable panel may be telescoped in or out of the lower portion of main panel 44 to either shorten or lengthen the height of the adjustable door 20. A plurality of cross beams 52 extend between side rails 50, and corner plates 51 join the uppermost cross beam 52 with side rails 50 to add rigidity and strength to the door structure. A pair of lifting handles 54 are mounted at the sides of main panel 44 and provide a convenient lifting point for the adjustable door 20 as it is installed on the boxcar 22. Platforms 56 are also provided on the door for the mounting of placards and the like for identification. Two operating handles 55 are mounted on the door to facilitate manual movement. An L-shaped spacer flange 57 is formed into the upper edge of main panel 44 to space the top of the door 20 away from the side of the boxcar as the top of the door slides within door retainer 30.

The double roller bogey 28 is shown more particularly in FIGS. 2–5 and includes a pair of traverse wheels 58, each of which is rotatably mounted by an axle pin 60 extending through a frame member 62 and abutting adjustable panel 46. This is best shown in cross-section in FIGS. 3 and 5. The frame 62 is in turn pivotally mounted by pivot pin 64 extending through and welded to an outer cover 66 and recessed in adjustable panel 46. Outer cover 66 is welded in place as shown and encapsulates the inner frame 62 and traverse wheels 58 to protect them from damage and abuse as they pivot during operation.

The safety stop 40 includes a spring loaded latch 68 with a beveled end 70 and a lifting hole 70 in its upper portion. A guide pin 71 and bracket 73 mount the latch 68 to the adjustable panel 46.

OPERATION AND METHOD OF INSTALLATION

Applicants' adjustable door 20 is designed to be quickly and easily adjusted to a required height, fixed to that height and installed on a boxcar. Applicants' door may be easily sized and installed using the following method. The dimension of the door opening must first be determined by measuring the distance from the top of the top retainer to the surface of the door track. This measurement should be taken at both door posts, at the half open position, and the full open position. The actual size of the door should be adjusted to about ⅜ inches to ½ inches less than the smallest measurement taken. Then, with the door on the ground, the adjustable panel is moved inwardly or outwardly from the main panel to achieve the proper door height as measured from the top of the door to the bottom of the traverse wheels. This distance should be measured through the center of each double roller bogey with the traverse wheels in a neutral or equally extended position. Once the proper position for the adjustable panel is determined, the adjustable panel should be securely welded to the main panel on both the front and back sides thereof.

After the height of the door is fixed, the width of the door may be adjusted by locating the spark strip along the back of the door. The door opening is measured to determine the distance from the frame to the spark strip on the car. A matching spark strip, as shown in FIG. 3, is then welded to the door to ensure an "interlock" between the spark strips as the door is closed.

The door may then be lifted by a portable crane or the like and mounted to the boxcar by first inserting the upper end of the door into the top retainer and then pivoting the door towards the boxcar so that the traverse wheels rest on the door track. Once in place, the door should be checked to ensure that it is properly positioned and then J-straps welded at each corner of the door to slidably secure the corners of the door to the underside of the door track. The door may then be operated a few times to test for proper fit and any adjustments made, as required.

Once a door is installed, it rides rather freely and easily over the door track through the unique rocking action of the double roller bogeys. Each double roller bogey includes an inner frame which is pivotally mounted to permit a "stepping action". The inner frame has a pair of rotatably mounted traverse wheels such that the entire door assembly is supported from the track by virtue of the four traverse wheels contained in the two double roller bogeys. When first installed, the track is relatively straight and very little pivoting action should be seen as the door is rolled from its open to closed position and vice versa. However, after the boxcar has been in operation for some time, the door track is subject to being damaged and kinks may develope in the track or obstructions fall on the track which would jam any door of the prior art. However, with applicants' unique double roller bogey, the first traverse wheel actually steps over or into any kinks or obstructions on the track and the pivoting action of the bogey shifts the weight of the door from one wheel to the other to facilitate this stepping action. Of course, there is sufficient looseness of fit in the top retainer and the J-straps to accommodate this stepping action.

Various changes and modifications to applicants' invention would be apparent to one of ordinary skill in the art. These changes and modifications are included in the teaching of applicants' invention and applicants intend that their invention be limited only by the scope of the claims appended hereto.

We claim:

1. A rolling type railroad boxcar door assembly for closing a boxcar opening including: a main panel and an adjustable panel, said main panel having a predetermined height slightly less than that of the opening to be covered; the adjustable panel being adapted to be secured to the end of the main panel, the end of the main panel having a flat surface along which the adjustable panel may slide, so that it may be slidably adjustable up and down against the edge of the main panel to combine with the main panel to provide a door that can cover the opening; retaining means to hold the adjustable panel slidably against the main panel during its slidable adjustment prior to its being fixedly secured to the main panel.

2. In a rolling type railroad boxcar door assembly for closing a boxcar opening having a main panel extending a predetermined height slightly less than that of the opening to be covered and a wheel means secured to the door, the improvement comprising an adjustable panel adapted to be secured to the end of the main panel, the end of the main panel having a flat surface along which the adjustable panel may slide so that it may be slidably adjustable up and down against the edge of the main panel to combine with the main panel to provide a door that can cover the opening, and retaining means to hold the adjustable panel slidably against the main panel during its slidable adjustment prior to its being fixedly secured to the main panel.

3. The device of claim 2 wherein the adjustable panel is secured at the lower end of the main panel and wherein the wheel means comprises at least one bogey assembly mounted in the lower portion of the adjustable panel, said bogey assembly including a pair of traverse wheels, said bogey assembly having wheel support means pivotally mounted on the adjustable panel about a horizontal pivot to pivot with respect to said door assembly as said traverse wheels roll along a support.

4. The device of claim 3 further comprising means to adjust the effective width of the door assembly including an adjustable spark strip initially separate from the assembly, and adjustably securable to the vertical edge of the door to size the door to one of various widths of door openings.

5. The device of claim 2 wherein the main panel includes a side rail at each side of said main panel, the adjustable panel being slidably received therebetween and the retaining means includes a stop block secured to the inside of each side rail and spaced from the main panel a distance slightly greater than the thickness of the adjustable panel, the adjustable panel having an upraised member at each end aligned with the stop block to prevent disengagement of the adjustable panel.

6. In a rolling type boxcar door assembly for closing a boxcar opening having a main panel extending a predetermined height slightly less than that of the opening to be covered, the improvement comprising an adjustable panel adapted to be secured to the bottom of the main panel, the bottom of the main panel having a flat surface along which the adjustable panel may slide so that it may be slidably adjustable up and down against the edge of the main panel to combine therewith to provide a door that can cover the opening, the adjustable panel having a wheel means mounted thereto so that replacement of the wheel means can be effected by replacement of the adjustable panel, and retaining means to hold the adjustable panel slidably against the main panel during its slidable adjustment prior to its being fixedly secured to the main panel.

7. The device of claim 6 wherein the wheel means comprises at least one bogey assembly including a pair of traverse wheels, said bogey assembly having a wheel support means pivotally mounted on the adjustable panel about a horizontal pivot to pivot with respect to said door assembly as said traverse wheels roll along a support.

8. The device of claim 7 wherein the wheel support means comprises a frame, and further comprising an outer cover secured to the adjustable panel and surrounding the frame.

9. A rolling type railroad boxcar door assembly for closing a boxcar opening comprising a main panel and an adjustable panel, said main panel having a predetermined height less than that of the opening to be covered, retaining means to hold the adjustable panel in sliding engagement with the main panel to provide relative sliding adjustment of the two panels to provide a door that can cover the opening, the sliding adjustability providing a range of door sizes for fitting a range of door openings, said panels having mating surfaces adapted to be secured together upon proper relative sliding adjustment of the panels.

10. The device of claim 9 wherein said retaining means further comprises side rails within which the side edges of at least one of said panels is slidably received, and stop means limiting the range of sliding movement of the adjustable panel with respect to the main panel.

11. The device of claim 10 wherein said main panel has a flat surface along which said adjustable panel may slide, and wherein the retaining means holds the adjustable panel slidably against the flat surface of the main panel upon adjustable sliding movement of the adjustable panel with respect to the main panel.

12. The device of claim 11 wherein the adjustable panel is secured at the lower end of the main panel and includes wheel bogeys at the lower end thereof for rolling engagement with a boxcar support.

* * * * *